US007066119B2

(12) United States Patent
Yasuda

(10) Patent No.: US 7,066,119 B2
(45) Date of Patent: Jun. 27, 2006

(54) TWO-STROKE ENGINE

(75) Inventor: Terutaka Yasuda, Chiba (JP)

(73) Assignee: Maruyama Mfg. Co., Inc. (JP)

( * ) Notice: Subject to any disclaimer, the term of this patent is extended or adjusted under 35 U.S.C. 154(b) by 0 days.

(21) Appl. No.: 11/058,077

(22) Filed: Feb. 15, 2005

(65) Prior Publication Data

US 2005/0183679 A1 Aug. 25, 2005

(30) Foreign Application Priority Data

Feb. 19, 2004 (JP) ..... 2004-043469

(51) Int. Cl.
*F02B 33/04* (2006.01)

(52) U.S. Cl. ..... 123/73 PP; 123/65 P

(58) Field of Classification Search ..... 123/73 PP, 123/65 P, 65 A, 73 A, 73 AA, 73 R
See application file for complete search history.

(56) References Cited

U.S. PATENT DOCUMENTS

| | | | |
|---|---|---|---|
| 6,173,683 | B1 | 1/2001 | Nemoto et al. |
| 6,367,431 | B1 | 4/2002 | Nemoto et al. |
| 6,367,432 | B1 * | 4/2002 | Araki ..... 123/73 R |
| 6,591,792 | B1 | 7/2003 | Nemoto et al. |
| 6,591,793 | B1 | 7/2003 | Nemoto et al. |
| 2003/0051684 | A1 | 3/2003 | Laydera |
| 2003/0217709 | A1 | 11/2003 | Geyer et al. |

FOREIGN PATENT DOCUMENTS

| | | |
|---|---|---|
| JP | 11-287124 | 10/1999 |
| JP | 2000-320338 | 11/2000 |
| JP | 2001-027122 | 1/2001 |
| JP | 2001-140650 | 5/2001 |
| JP | 2001-140651 | 5/2001 |

OTHER PUBLICATIONS

European Search Report issued on Application No. 0500282801-2311; Dated Jan. 11, 2006; 3 pages.

* cited by examiner

*Primary Examiner*—Henry C. Yuen
*Assistant Examiner*—Hyder Ali
(74) *Attorney, Agent, or Firm*—Osha Liang LLP

(57) ABSTRACT

A two-stroke engine includes a scavenging passage opening in a combustion chamber in a scavenging stroke to fill the combustion chamber with a working gas containing a fuel; and a scavenge filling chamber communicating through a communicating port with the scavenging passage and arranged to be filled with a non-working gas in a fuel weight concentration smaller than that of the working gas prior to the scavenging stroke. In the scavenging stroke, the scavenging passage and the scavenging filling chamber are made open in the combustion chamber and the non-working gas in the scavenge filling chamber is forced into the combustion chamber by the working gas inside the scavenging passage through the communicating port to scavenge the combustion chamber.

7 Claims, 9 Drawing Sheets

TWO-STROKE ENGINE

BACKGROUND OF THE INVENTION

1. Field of the Invention

The present invention relates to a two-stroke engine to be mounted, for example, on a lawn mower, a backpacked power sprayer, or the like and, more particularly, to a two-stroke engine achieving reduction of hydrocarbons (THC: Total Hydro Carbon: total amount of hydrocarbons) in exhaust gas.

2. Related Background Art

In a two-stroke engine mounted on a lawn mower or a backpacked power sprayer, an air-fuel mixture in a crank chamber is introduced through a scavenging port into a combustion chamber in a scavenging stroke to fill the combustion chamber while scavenging the combustion chamber. For this reason, the conventional two-stroke engines experienced so-called "blow-by": the fresh charge gas (air-fuel mixture) introduced through the scavenging port into the combustion chamber directly blew through the exhaust port without staying in the combustion chamber. This blow-by mixture was sometimes released as unburned gas into the atmosphere without being cleaned up. In recent years, in order to reduce the blow-by of the air-fuel mixture, two-stroke engines performing so-called stratified scavenging were put into practical use (Japanese Patent Application Laid-Open No. 2001-140651 and Japanese Patent Application Laid-Open No. 2000-320338).

SUMMARY OF THE INVENTION

In the stratified scavenging, the exhaust gas refluxed from the exhaust system or the like, or a gas without fuel such as air introduced from the intake system (these refluxed exhaust gas and intake air will be collectively called non-working gas), and the fresh charge gas (hereinafter referred to as working gas) are introduced into the combustion chamber in the scavenging stroke. At this time, the non-working gas and the working gas are not homogeneously fully mixed, but fill the combustion chamber so as to form a laminar boundary, and only the non-working gas layer undergoes blow-by after scavenging, thereby preventing the blow-by of THC.

The ideal stratified scavenging is such that the entire blow-by gas in the scavenging stroke is the non-working gas without the blow-by component of the working gas consisting of the fresh charge air and the non-working gas completely blows across the combustion chamber without staying inside the combustion chamber. In the conventional stratified scavenging, however, a mixed layer in which the non-working gas and the working gas coexist (or are mixed) was present in the laminar boundary part between the non-working gas layer and the working gas layer. For this reason, where the mixed layer was included in the blow-by gas, it led to an increase in fuel consumption due to a decrease of trapping efficiency. It can also cause an increase in the atmospheric discharge amount of THC components to be cleaned up. Where the mixed layer stays in the combustion chamber, the non-working gas in the mixed layer goes together with the working gas through the combustion stroke, so as to cause a power drop due to a decrease of delivery ratio.

There were thus desires for such an improvement that this mixed layer was eliminated (or reduced) to make the laminar boundary clearer between the non-working gas layer and the working gas layer. This improvement can solve the aforementioned problem. Therefore, an object of the present invention is to provide a two-stroke engine capable of more efficiently reducing the blow-by of the air-fuel mixture.

A two-stroke engine (10) of the present invention comprises a scavenging passage (19) opening in a combustion chamber (12) in a scavenging stroke to fill the combustion chamber with a working gas containing a combustion fuel; and a scavenge filling chamber (18) communicating through a communicating port (21) with the scavenging passage (19) and arranged to be filled with a non-working gas in a fuel weight concentration smaller than that of the working gas prior to the scavenging stroke, wherein in the scavenging stroke the scavenging passage (19) and the scavenge filling chamber (18) are made open in the combustion chamber (12) and the non-working gas in the scavenge filling chamber (18) is forced into the combustion chamber (12) by the working gas inside the scavenging passage (19) through the communicating port (21) to scavenge the combustion chamber (12).

The two-stroke engine (10) of the present invention embraces, particularly, a Schnürle-method two-stroke engine. The Schnürle method is also called a collision reverse type, in which gas flows are introduced into the combustion chamber through a pair of scavenging ports disposed in symmetry on a transverse plane of the combustion chamber (a projection plane normal to the center axis of the combustion chamber) to collide with each other to form reverse vortices. The Schnürle-method two-stroke engine makes use of the reverse vortices to implement effective scavenging.

In the present invention, the non-working gas in the fuel weight concentration smaller than that of the working gas embraces a gas in the fuel weight concentration of 0, of course. The working gas is, for example, a gas introduced from a carburetor through an intake port (15) into a crank chamber (28) in an intake stroke and then introduced through the scavenging passage (19) into the combustion chamber (12), and in this process a desired amount of exhaust gas may be mixed therein (provided that the fuel weight concentration of the working gas should be larger than that of the aforementioned non-working gas).

The scavenge filling chamber (18) is filled with the non-working gas prior to the scavenging stroke, and in the scavenging stroke this non-working gas thus filling the chamber is introduced into the combustion chamber (12) to effect scavenging. However, this does not mean that the non-working gas should be continuously supplied from the scavenge filling chamber (18) throughout the entire period of the scavenging stroke. Namely, in a late stage of the scavenging stroke in which the blow-by rate of gas through an exhaust port (16) is lower, the working gas moving from the scavenging passage (19) through the communicating port (21) into the scavenge filling chamber (18) may be introduced from the scavenge filling chamber (18) into the combustion chamber (12) as the working gas is charged from the scavenging passage (19).

The scavenge filling chamber (18) is filled with the non-working gas prior to the scavenging stroke, and the scavenge filling chamber (18) is in communication through the communicating port (21) with the scavenging passage (19). As far as the working gas does not enter through the communicating port (21), the non-working gas in the scavenge filling chamber (18) is not mixed with the working gas. During or after the filling of the scavenge filling chamber (18) with the non-working gas, the working gas is unlikely to enter the interior of the scavenge filling chamber (18) formed as a filling room, through the communicating port (21), whereby the working gas is unlikely to be mixed with the non-working gas. Namely, during the filling of the scavenge filling chamber (18) with the non-working gas, the non-working gas in the scavenge filling chamber (18) is discharged through the communicating port (21) toward the scavenging passage (19) side and thus the working gas is prevented from moving from the scavenging passage (19) side to the scavenge filling chamber (18) side. After the filling with the non-working gas, the interior of the scavenge filling chamber (18) as a filling room is filled with the non-working gas, so as to prevent the inflow of the working gas through the communicating port (21).

For this reason, the working gas is not mixed with the non-working gas in the scavenge filling chamber (18) before the scavenging stroke, and in the scavenging stroke the non-working gas is introduced from the scavenge filling chamber (18) into the combustion chamber (12) and the working gas is introduced from the scavenging passage (19) into the combustion chamber (12), whereupon a laminar boundary becomes clear between the non-working gas layer and the working gas layer. The mixed layer is not formed (or is barely formed if any) because of creation of the clear laminar boundary, which makes it easier to implement the blow-by of the non-working gas only and to keep the working gas only staying in the combustion chamber (12). This prevents the working gas from being contained as a mixed layer during the blow-by, and prevents an increase of fuel consumption. It is also feasible to prevent the non-working gas from staying as a mixed layer in the combustion chamber (12) and causing a power drop due to a decrease of delivery ratio.

The two-stroke engine is preferably constructed as described below. The two-stroke engine (10) further comprises a cylinder block (11) forming the combustion chamber (12); a piston (33) to reciprocate in the combustion chamber; and a crank chamber (28) into which the working gas is to be introduced through an intake port (15). The scavenging passage (19) and the scavenge filling chamber (18) extend in the cylinder block so as to be adjacent to each other along an axial direction of the combustion chamber (12), and the scavenge filling chamber (18) has an aperture (18*a*) to open in the combustion chamber (12) when the piston (33) is located at a position near a bottom dead center. The scavenging passage (19) has an aperture (19*a*) to open in the combustion chamber (12) when the piston (33) is located at a position near the bottom dead center, and one end of the scavenging passage is in communication with the crank chamber (28). The communicating port (21) opens in a bulkhead (20) interposed between the scavenging passage (19) and the scavenge filling chamber (18) and its opening direction is perpendicular to a gas flow direction in the scavenging passage (19).

Since the opening direction of the communicating port (21) for communication between the scavenging passage (19) and the scavenge filling chamber (18) is perpendicular to the gas flow direction in the scavenging passage (19), the working gas on the scavenging passage (19) side is hardly mixed with the non-working gas on the scavenge filling chamber (18) side, so as to form no mixed layer in the aforementioned laminar boundary part (or barely form the mixed layer, if any), whereby the laminar boundary becomes clear. This makes it easier to implement the blow-by of the non-working gas only and to keep the working gas only staying in the combustion chamber (12).

The two-stroke engine is further preferably constructed as described below. A wall part of the scavenge filling chamber on the bottom dead center side of the piston (33) is formed by a gasket (24) sandwiched between the cylinder block (11) forming the combustion chamber (12) and a crank case (27) forming the crank chamber (28). This permits easy formation of the scavenge filling chamber (18) in such a manner that a hollow for the scavenge filling chamber (18) is formed in the cylinder block (11) and the crank case (27) just like the scavenging passage (19) and an opening portion of this hollow is closed by the gasket (24). There is neither need for increase in the number of parts nor for addition of an extra processing step, because the gasket (24) between the cylinder block (11) and the crank case (27) is utilized.

The two-stroke engine is further preferably constructed as described below. The intake port (15) and the exhaust port (16) are located at positions substantially opposite to each other with respect to a center of the combustion chamber (12) on a projection plane normal to the center axis of the combustion chamber (12) Each of the scavenge filling chamber (18) and the scavenging passage (19) comprises a pair arranged one on each side in symmetry with respect to a line connecting the intake port (15) to the exhaust port (16), and the pair of scavenge filling chambers (18) are placed on the exhaust port (16) side with respect to the pair of scavenging passages (19).

The non-working gas introduced from the scavenge filling chambers (18) into the combustion chamber (12) and the working gas introduced from the scavenging passages (19) into the combustion chamber (12) are discharged through the exhaust port (16) while scavenging the interior of the combustion chamber (12). Since the scavenge filling chambers (18) are located on the exhaust port (16) side with respect to the scavenging passages (19), the non-working gas introduced from the scavenge filling chambers (18) is introduced to the exhaust port (16) side, and the non-working gas becomes likely to be discharged as a blow-by, whereby it is feasible to effectively prevent the blow-by of the working gas.

The two-stroke engine is further preferably constructed as described below. The pair of scavenging passages (19) and the pair of scavenge filling chambers (18) each are oriented so that introduced gases therefrom into the combustion chamber (12) in the scavenging stroke collide with each other on the opposite side to the exhaust port (16).

The working gases introduced from the pair of scavenging passages (19) into the combustion chamber (12) collide with each other to form reverse vortices. The non-working gases introduced from the pair of scavenge filling chambers (18) into the combustion chamber (12) also collide with each other to form reverse vortices. The reverse vortices of the working gases are inhibited from blowing through the exhaust port (16) by the flows of the non-working gases introduced on the exhaust port (16) side and the existence of the reverse vortices thereof. The reverse vortices realize appropriate scavenging inside the combustion chamber (12).

The two-stroke engine is further preferably constructed as described below. The non-working gas is comprised essentially of an exhaust gas refluxed from an exhaust system. The non-working gas comprised essentially of the exhaust gas may be the exhaust gas itself, or may be a gas resulting from mixing of the exhaust gas with another gas containing no fuel (e.g., part of intake air, or air newly introduced from the outside, or the like).

Supply of the exhaust gas from the exhaust system into the scavenge filling chambers (18) in the case where the non-working gas is comprised essentially of the exhaust gas is implemented through a communication path (40) formed in the piston (33) and/or in a wall part of the combustion chamber (12) so as to bring the scavenge filling chambers (18) into communication with the exhaust port (16), when the piston (33) to reciprocate in the combustion chamber (12) is located near a top dead center. When the communication path (40) is formed in the surface of the piston (33) and/or in the wall part of the combustion chamber (12), it is formed as a groove; when it is formed inside the piston (33) and/or inside the wall part of the combustion chamber (12), it is formed as a hole. The communication path (40) may be formed as a groove in part and a hole in the other part.

Since the piston (33) is located near the top dead center immediately after the movement of the piston (33) from the bottom dead center toward the top dead center, a positive pressure from the exhaust downstream side acts at the exhaust port (16). When the exhaust port (16) is brought into communication with the scavenge filling chambers (18) through the aforementioned communication path (40) at this time, the positive pressure forces the exhaust gas into the scavenge filling chambers (18) to fill the scavenge filling chambers. Where the scavenging passages (19) are in communication with the interior of the crank chamber (28), a negative pressure acts inside the crank chamber (28) when the piston (33) is located near the top dead center. For this reason, this negative pressure acts on the scavenge filling chambers (18) through the scavenging passages (19) and the communicating ports (21) (establishing communication between the scavenging passages (19) and the scavenge filling chambers (18)). This action of the negative pressure promotes the supply of the exhaust gas from the exhaust port (16) through the aforementioned communication path (40). In this structure, the inflow/outflow control of the non-working gas is performed by the pressure difference in conjunction with the movement of the piston (33) and there is no need for addition of an extra switching valve in the communication path (40), so as to simplify the structure.

The two-stroke engine is further preferably constructed as described below. The non-working gas is comprised essentially of intake air without fuel introduced from an exterior atmospheric space. The non-working gas comprised essentially of the intake air may be the atmospheric air itself, or a gas resulting from mixing thereof with another gas containing no fuel (e.g., newly introduced air different from air taken in for the purpose of combustion, an inert gas in storage, or the like).

Supply of the intake air into the scavenge filling chambers (18) in the case where the non-working gas is comprised essentially of the intake air is implemented through a communication path (41) formed in the piston (33) and/or in the wall part of the combustion chamber (12) so as to bring the scavenge filling chambers (18) into communication with an air passage (17) for supplying the intake air without fuel to the scavenge filling chambers (18), when the piston (33) to reciprocate inside the combustion chamber (12) is located near the top dead center. The communication path (41) is formed as a groove when it is formed in the surface of the piston (33) and/or the wall part of the combustion chamber (12); it is formed as a hole when it is formed inside the piston (33) and/or the wall part of the combustion chamber (12). The communication path (41) may also be formed as a groove in part and a hole in the other part. The air passage (17) to be brought in communication with the communication path (41) is a passage for supplying the intake air containing no fuel (e.g., the intake air before mixed with the fuel component). In this structure, there is no need for addition of an extra switching valve in the communication path (41), so as to simplify the structure.

DESCRIPTION OF THE PREFERRED EMBODIMENTS

Figure 1:
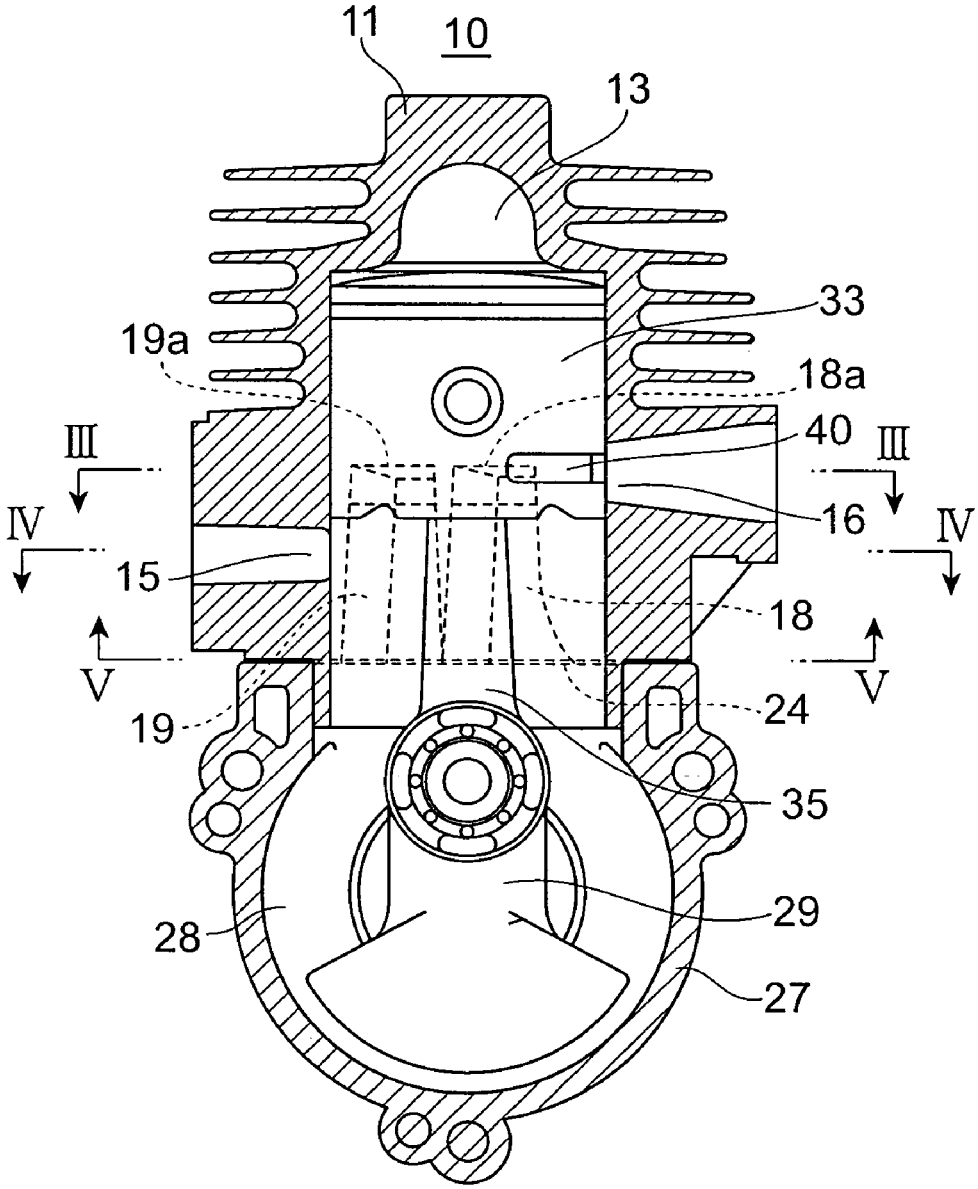
FIG. 1 is a sectional view (with the piston at the top dead center) showing the first embodiment of the two-stroke engine of the present invention.
Figure 2:
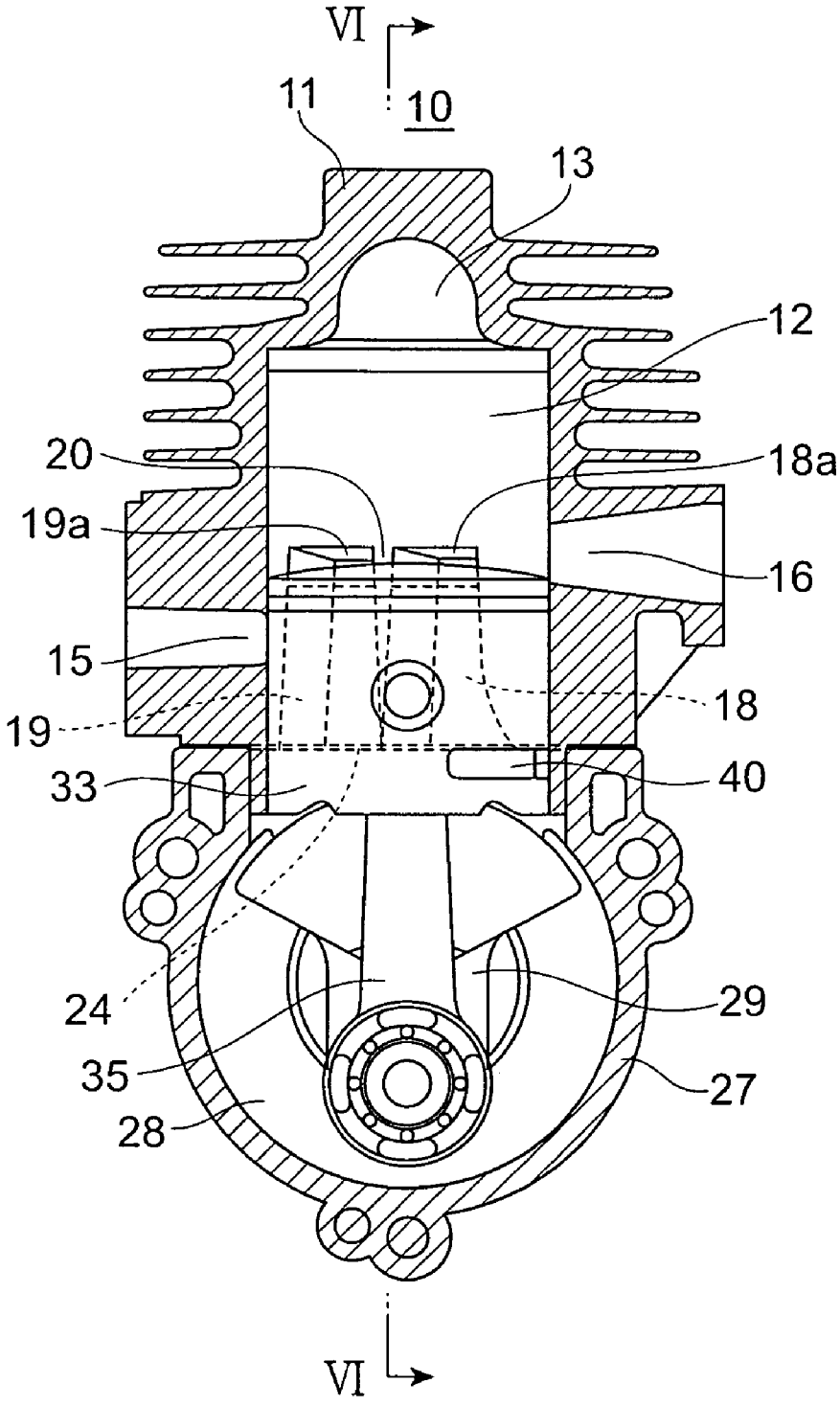
FIG. 2 is a sectional view (with the piston at the bottom dead center) showing the first embodiment of the two-stroke engine of the present invention.
Figure 3:
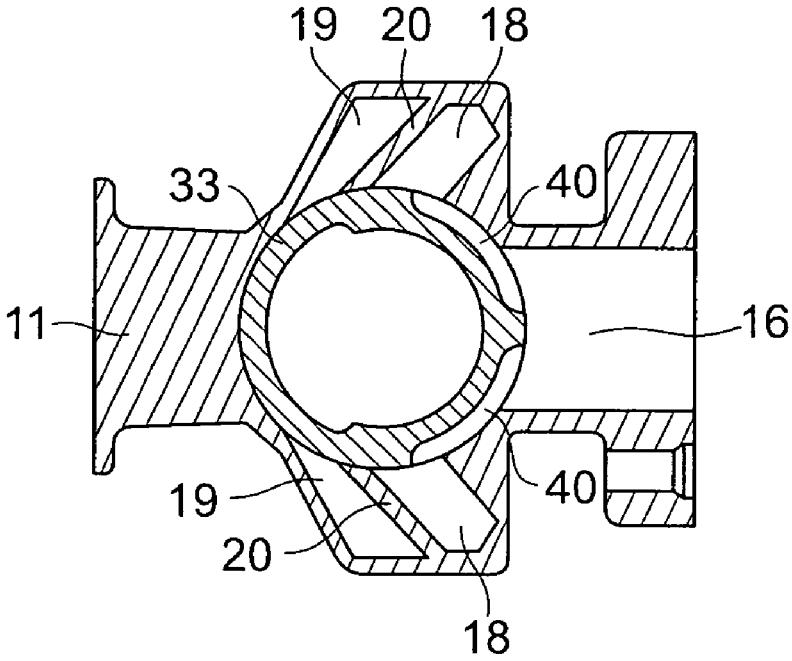
FIG. 3 is a sectional view along III—III line in FIG. 1.
Figure 5:
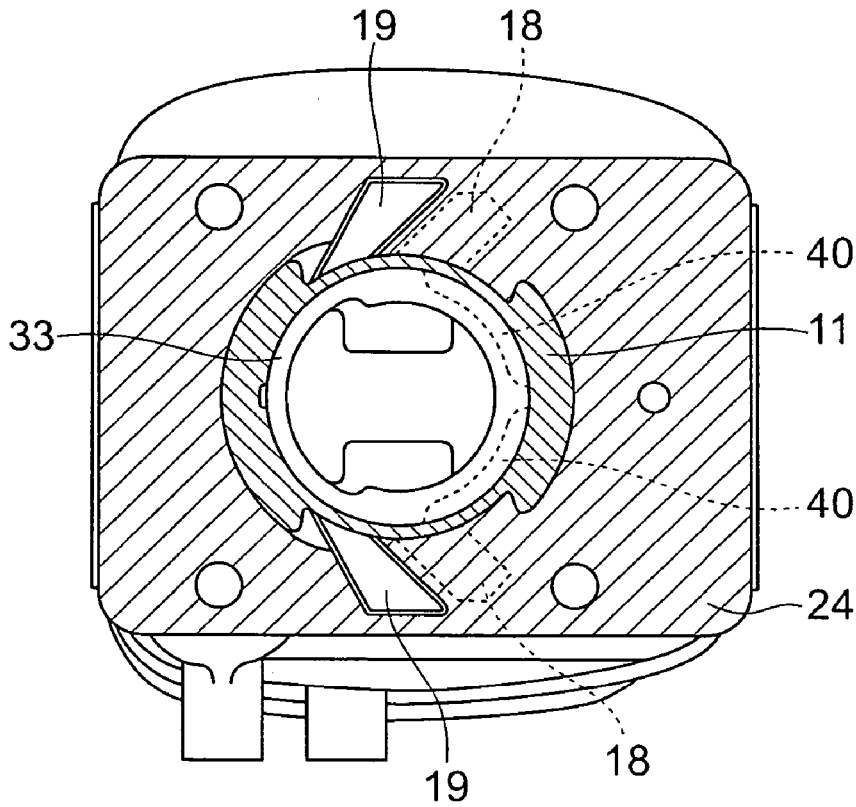
FIG. 5 is a sectional view along V—V line in FIG. 1.
Figure 6:
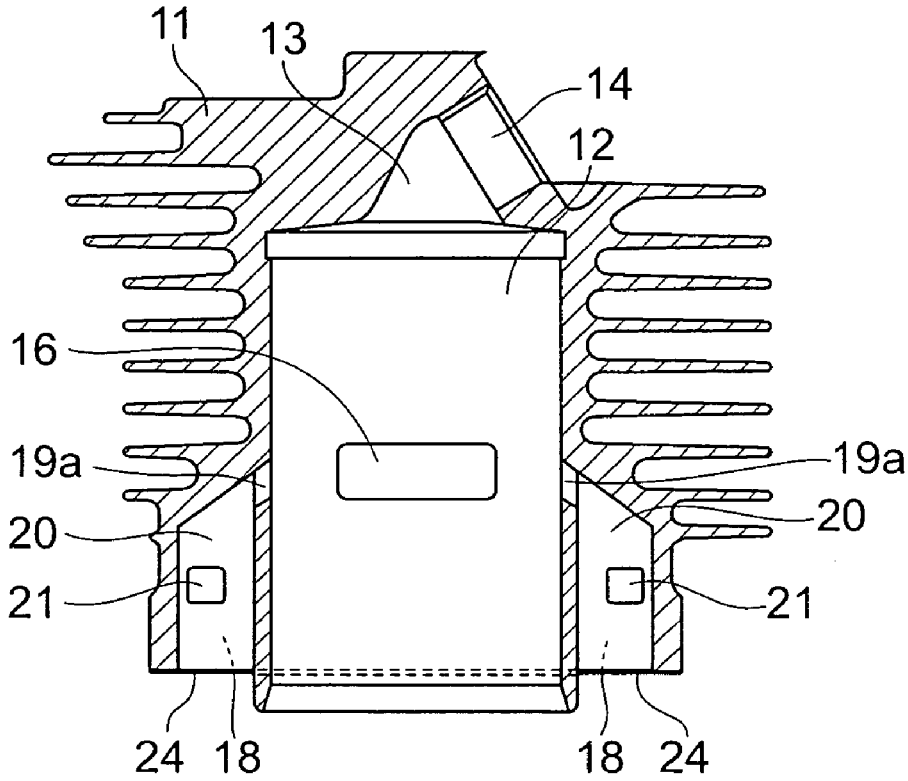
FIG. 6 is a sectional view along VI—VI line in FIG. 2.

The first embodiment of the present invention will be described below with reference to the drawings. FIG. 1 and FIG. 2 are vertical sectional views of Schnürle-method two-stroke engine 10 of the present embodiment. In FIG. 1 the piston 33 is at the top dead center and in FIG. 2 the piston dJ3 at the bottom dead center. FIG. 3 is a sectional view along III—III line in FIG. 1, FIG. 4 a sectional view along IV—IV line in FIG. 1, and FIG. 5 a sectional view along V—V line in FIG. 1. FIG. 6 is a sectional view along VI—VI line in FIG. 2 (of cylinder block 11 only).

The Schnürle-method two-stroke engine 10 is mounted, for example, on a lawn mower or on a backpacked power sprayer. A cylinder (combustion chamber) 12 is formed in a cylinder block 11. The cylinder 12 extends along the center line of the cylinder block 11 and inside the cylinder block 11 and opens in the lower end face of the cylinder block 11. A recess 13 is formed in the top part of the cylinder 12 and a discharge electrode of a spark plug not shown is placed inside the recess 13. A spark plug mounting hole 14 is shown in FIG. 6.

The upper part of the cylinder 12 and the part of recess 13 function as a combustion chamber. An intake port 15 and an exhaust port 16 establish communication between the outside of the cylinder block 11 and the interior of the cylinder 12. The intake port 15 and exhaust port 16 are formed at positions 180° apart in the circumferential direction of the cylinder 12 and in the peripheral wall of the cylinder block 11 so that the exhaust port 16 is located nearer the top dead center than the intake port 15 in the height direction of the cylinder 12. Namely, where a projection plane is defined as a plane perpendicular to the center axis of the cylinder 12, when the positions of the intake port 15 and exhaust port 16 are projected onto this projection plane, the intake port 15 and exhaust port 16 are located at the positions substantially opposite to each other with respect to the center of the cylinder 12.

A plurality of cooling fins for heat radiation formed on the outer surface of the cylinder block 11 project outwards in parallel with each other in the radial direction-of the cylinder block 11 and near the top dead center of the cylinder block 11. Scavenge filling chambers 18 and scavenging passages 19 have their respective apertures 18*a*, 19*a* opening inside the cylinder 12 near the top dead center. These apertures are located at much the same height as the exhaust port 16 is in the axial direction of the cylinder 12, and are positioned to open in the combustion chamber as the piston 33 approaches the bottom dead center.

Figure 4:
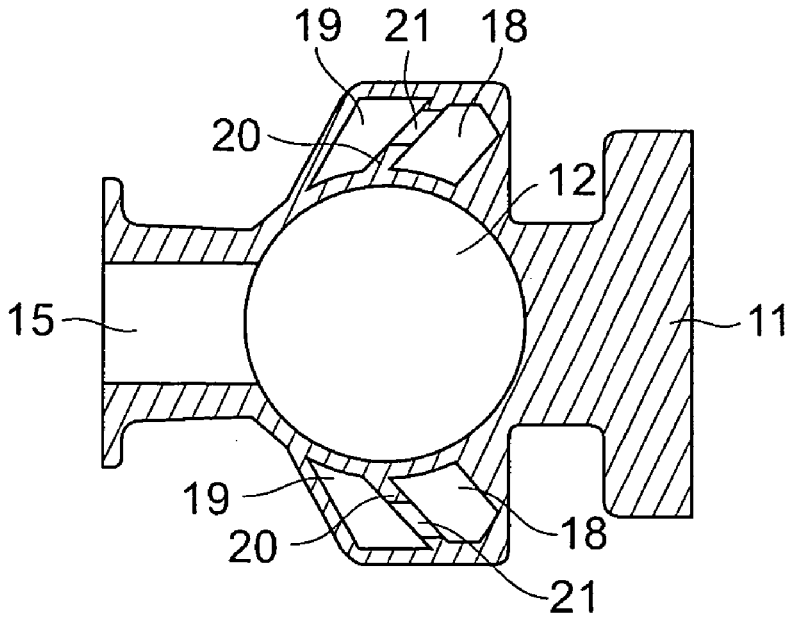
FIG. 4 is a sectional view along IV—IV line in FIG. 1.

The scavenge filling chambers 18 and scavenging passages 19 all are formed in the cylinder block 11 outside the cylinder 12 and extend in the axial direction of the cylinder 12. The scavenge filling chambers 18 and scavenging passages 19 are provided two each as paired. The pair of scavenge filling chambers 18 are placed one on each side in symmetry with respect to a line connecting the intake port 15 to the exhaust port 16 when their positions are projected onto the aforementioned projection plane. Likewise, the pair of scavenging passages 19 are also placed one on each side in symmetry with respect to the line connecting the intake port 15 to the exhaust port 16. On the projection plane, the pair of scavenge filling chambers 18 are located nearer the exhaust port 16 than the pair of scavenging passages 19. The pair of scavenge filling chambers 18 and the pair of scavenging passages 19, as shown in FIGS. 3 and 4 (which are not projected figures but sectional views), each are oriented so that on the aforementioned projection plane, introduced gases therefrom into the cylinder 12 collide with each other on the opposite side to the exhaust port 16.

As seen from FIG. 6, the ends of the scavenge filling chambers 18 and scavenging passages 19 on the top dead center side are inclined toward the recess 13. The gases to be supplied from the scavenge filling chambers 18 and from the scavenging passages 19 into the cylinder 12 are introduced in the directions toward the recess 13 in the top part of the cylinder 12, so as to effect better scavenging inside the combustion chamber. With regard to the cylinder block 11, the scavenge filling chambers 18 and the scavenging passages 19 both have their ends open on the bottom dead center side. However, concerning the scavenge filling chambers 18, their open ends are closed by a gasket 24 sandwiched between the cylinder block 11 and crank case 27. The scavenge filling chamber 18 and the scavenging passage 19 adjacent to each other are isolated from each other by bulkhead 20, and this bulkhead 20 is provided with a communicating port 21 for communication between the scavenge filling chamber 18 and the scavenging passage 19. The bulkhead 20 is located approximately in parallel with the flow of gas stream in the scavenging passage 19. For this reason, the communicating port 21 formed in the bulkhead 20 opens approximately perpendicularly to this gas stream.

The crank case 27 has its upper surface joined to the lower surface of cylinder block 11. A crank chamber 28 is formed inside the crank case 27. The crank chamber 28 is always in communication with the scavenging passages 19 but is not in communication with the scavenge filling chambers 18 because of the aforementioned gasket 24. The crank chamber 28 is brought into communication with the intake port 15 when the piston 33 is located near the top dead center (cf. FIG. 1). A crank shaft 29 is rotatably journaled on the wall at both ends of the crank case 27. The piston 33 is slidably fitted in the cylinder 12 and reciprocates inside the cylinder 12. As the piston reciprocates inside the cylinder 12, the volume of the combustion chamber increases and decreases. A connecting rod 35 is rotatably coupled at one end thereof to the piston 33 and rotatably coupled at the other end to the crank shaft 29.

A pair of communication paths 40 are formed in groove shape in the lower end of the peripheral surface of the piston 33. On the aforementioned projection plane, the communication paths 40 extend in the range from the exhaust port 16 to the scavenge filling chambers 18 on the circumference of the piston 33. When the piston 33 is located near the top dead center, each communication path 40 gets its both ends communicating with the exhaust port 16 and with the aperture 18*a* of the scavenge filling chamber 18, so as to establish mutual communication between the exhaust port 16 and the scavenge filling chamber 18 (cf. FIG. 3).

The operation of the Schnürle-method two-stroke engine 10 of the present embodiment will be described. First, in a stroke in which the piston 33 moves from the bottom dead center to the top dead center, the volume of the combustion chamber decreases, while the volume on the crank chamber 28 side increases. The exhaust port 16 is closed by the piston 33 with the movement of the piston 33 from the bottom dead center to the top dead center, so as to compress the air-fuel mixture (a mixture of fuel and air) in the combustion chamber. With further movement of the piston 33 toward the top dead center, the intake port 15 comes into communication with the crank chamber 28, and then the air-fuel mixture from the carburetor is introduced through the intake port 15 into the crank chamber 28 in tandem with the compression of the air-fuel mixture in the combustion chamber.

When further movement of the piston 33 brings the piston 33 to near the top dead center, discharge of the spark plug occurs to cause ignition and explosion of the fuel in the air-fuel mixture inside the combustion chamber and its explosive power moves the piston 33 toward the bottom dead center. When the piston 33 is located in the vicinity of the top dead center, the lower end of the piston 33 reaches the height of the scavenge filling chambers 18, whereupon the scavenge filling chambers 18 come into communication through the communication paths 40 with the exhaust port 16 (the state of FIG. 1). At this time, the scavenge filling chambers 18 are under action of the positive pressure from the exhaust system through the exhaust port 16 on the communication path 40 side and under action of the negative pressure in the crank chamber 28 in the intake stroke on the communicating port 21 side. Accordingly, the gas existing in each scavenge filling chamber 18 is discharged through the communicating port 21 to the scavenging passage 19 side and the exhaust gas from the exhaust port 16 is supplied into the scavenge filling chambers 18 to fill them.

After the ignition of the air-fuel mixture, the piston 33 starts to move toward the bottom dead center and this movement terminates the communication between the exhaust port 16 and the scavenge filling chambers 18 through the communication paths 40. At this time, the scavenge filling chambers 18 are in communication with the crank chamber only through the communicating ports 21 and scavenging passages 19 having functioned to suck the gas out, and thus the exhaust gas (non-working gas) in the scavenge filling chambers 18 is prevented from being mixed with the air-fuel mixture (working gas) in the crank chamber 28. Although the communicating ports 21 still remain opening definitely, the interior of the scavenge filling chambers 18 is already filled with the non-working gas and therefore the working gas does not flow thereinto through the communicating ports 21 (or the inflow thereof can be negligibly small).

In the two-stroke engine described in aforementioned [Patent Document 1], the portions corresponding to the scavenge filling chambers 18 in the present embodiment were also formed in the same structure as the scavenging passages 19 in the present embodiment, and were open at their one end in the crank chamber. For this reason, when the non-working gas (exhaust gas) was introduced from the exhaust system with the piston being located near the top dead center, the working gas (air-fuel mixture) was likely to flow into those portions from the end side of open end.

Particularly, since the flow of gas at this time was directed along the scavenging passages, the working gas was likely to flow into those portions.

In contrast to it, the scavenge filling chambers 18 of the present embodiment are closed by the gasket as described above, at their end on the crank chamber 28 side. For this reason, the working gas is prevented from being mixed with the non-working gas filled in the scavenge filling chambers 18. Since the communicating ports 21 open in the direction perpendicular to the direction along the scavenging passages 19 (the flow direction in the scavenging passages 19), there occurs little inflow/outflow of gas through the communicating ports 21, and thus the working gas is prevented from being mixed with the non-working gas in the scavenge filling chambers 18.

With further movement of the piston 33 toward the bottom dead center, the exhaust port 16 and each of the apertures 18*a*, 19*a* of the scavenge filling chambers 18 and the scavenging passages 19 on the top dead center side come to open in the combustion chamber. At this time, by virtue of the positive pressure in the crank chamber 28 arising with movement of the piston 33, the working gas (air-fuel mixture) is introduced through the scavenging passages 19 into the combustion chamber. At the same time as it, the apertures 18*a* of the scavenge filling chambers 18 at the end near the top dead center become open, and then the working gas flows from the scavenging passage 19 side through the communicating port 21 into each scavenge filling chamber 18. In conjunction therewith, the non-working gases (exhaust gases) filled in the scavenge filling chambers 18 are forced through the apertures 18*a* near the top dead center into the combustion chamber.

The working gas is not introduced through the scavenge filling chambers 18 into the combustion chamber until the non-working gases filled inside the scavenge filling chambers 18 are completely forced from the scavenge filling chambers 18 into the combustion chamber. For this reason, the working gas layer introduced through the scavenging passages 19 into the combustion chamber and the non-working gas layer introduced through the scavenge filling chambers 18 into the combustion chamber scavenge the interior of the combustion chamber while maintaining a clear boundary between them. Namely, no mixed layer of the two gases is formed between the non-working gas layer and the working gas layer (or the mixture is negligibly small if formed). The working gas streams introduced from the pair of scavenging passages 19 into the combustion chamber collide with each other on the opposite side to the exhaust port 16 because of the shape of the scavenging passages 19, to form reverse vortices, and then move toward the exhaust port 16 while scavenging the interior.

At this time, on the exhaust port 16 side with respect to this working gas, the non-working gas streams introduced from the pair of scavenge filling chambers 18 into the combustion chamber also form reverse vortices in similar fashion to inhibit movement of the working gas toward the exhaust port 16. This prevents the blow-by of the working gas and the non-working gas is first discharged through the exhaust port 16. When the aforementioned clear laminar boundary part between the non-working gas layer and the working gas layer reaches the exhaust port 16, the piston 33 starts rising to close the exhaust port 16. This allows only the non-working gas to undergo blow-by, but does not allow the working gas to undergo blow-by. Since the laminar boundary is clear, no excessive non-working gas remains in the combustion chamber, and the non-working gas undergoes secure blow-by.

As described above, the communicating ports 21 open approximately perpendicularly to the flow of the gas streams introduced from the scavenge filling chambers 18 and from the scavenging passages 19 into the combustion chamber. For this reason, just as in the process of filling the scavenge filling chambers 18 with the non-working gas, there occurs no mixture of the non-working gas and the working gas during this scavenging stroke between the scavenge filling chambers 18 and the scavenging passages 19 through the communicating ports 21. This also more effectively prevents disturbance of the laminar flow with the clear laminar boundary.

This configuration prevents the working gas from being mixed with the non-working gas filled in the scavenge filling chambers 18, and thus the aforementioned mixed layer is not formed. For this reason, it becomes easy to make only the non-working gas undergo blow-by and to prevent the working gas from undergoing blow-by, and it thus becomes feasible to effectively reduce the amount of exhaust THC. An increase of trapping efficiency also permits a decrease of fuel consumption. Furthermore, the non-working gas remaining in the combustion chamber is also reduced, and the delivery ratio increases to raise an expectation of power increase as well.

In the present embodiment, even if an overflow occurs during the filling process of the non-working gas into the scavenge filling chambers 18, the non-working gas will be trapped inside the scavenging passages 19. Namely, the scavenging passages 19 serve like a buffer, also to prevent the non-working gas from being mixed with the working gas in the crank chamber 28. Since the non-working gas overflowing into the scavenging passages 19 is first introduced into the combustion chamber prior to the inflow of the working gas in the scavenging stroke, the stratified scavenging flow is not disturbed and there arises no problem in terms of reduction of THC and securing of power.

Figure 7:
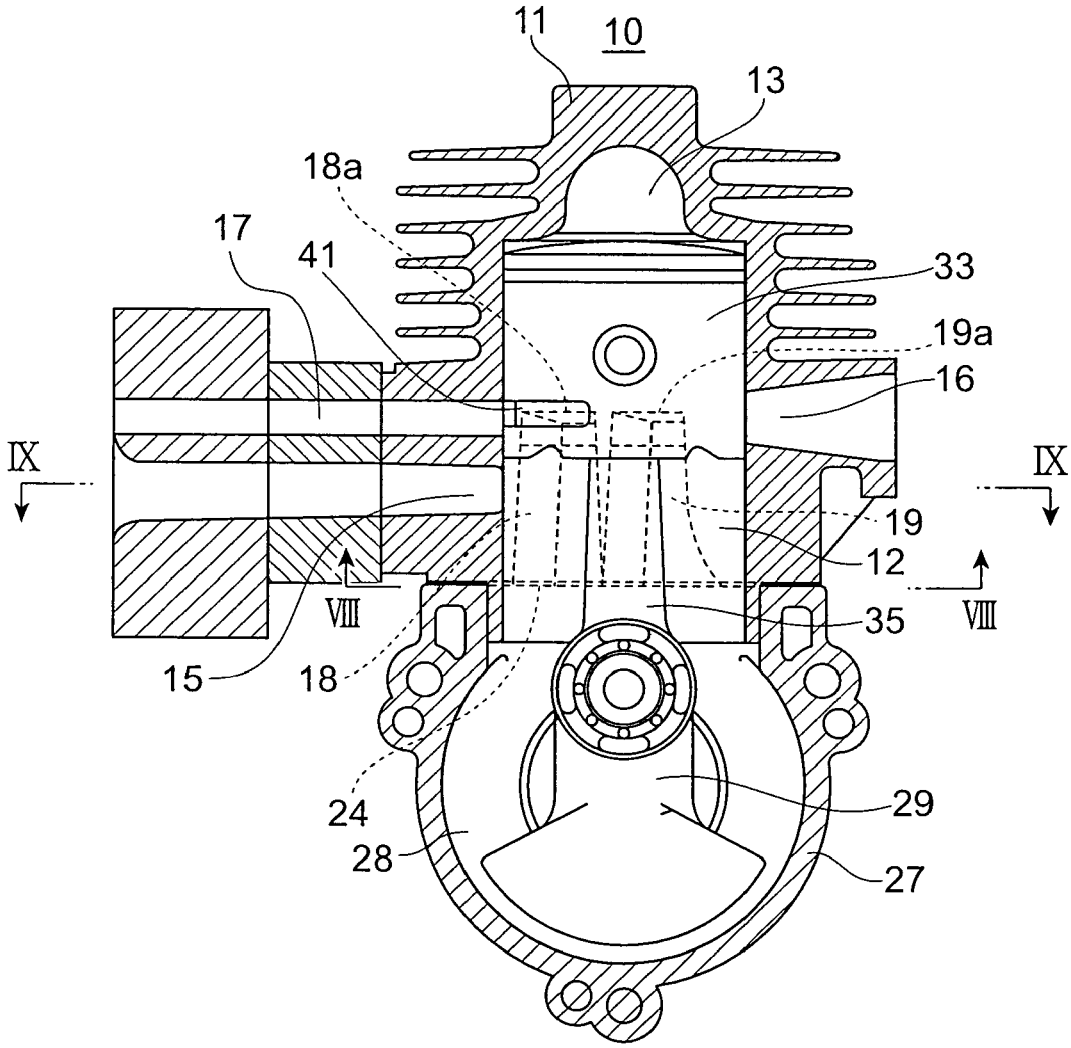
FIG. 7 is a sectional view (with the piston at the top dead center) showing the second embodiment of the two-stroke engine of the present invention.
Figure 8:
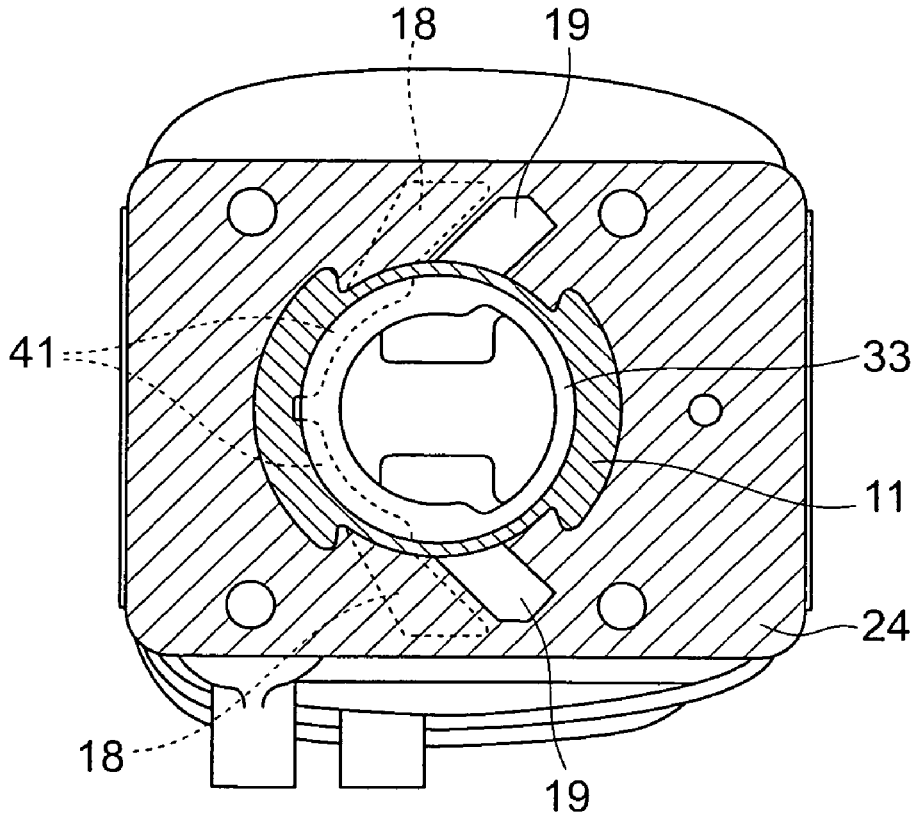
FIG. 8 is a sectional view along VIII—VIII line in FIG. 7.
Figure 9:
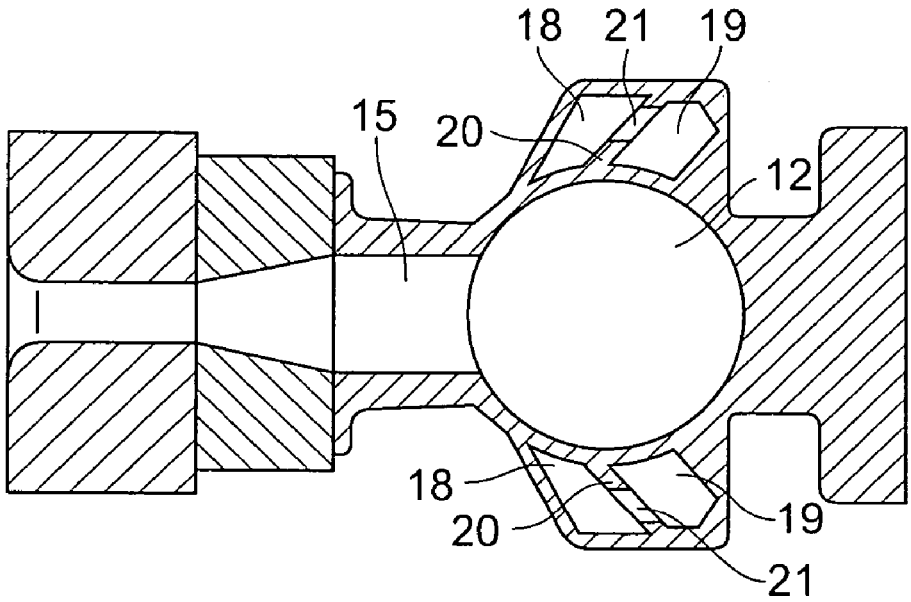
FIG. 9 is a sectional view along IX—IX line in FIG. 7.

FIGS. 7 to 9 show the second embodiment of the present invention. Many components in the present embodiment are identical or equivalent to those in the aforementioned first embodiment. For this reason, the identical or equivalent components to those in the aforementioned first embodiment will be denoted by the same reference symbols, without detailed description thereof. FIG. 7 is a view corresponding to FIG. 1 of the first embodiment. FIG. 8 is a sectional view along VIII—VIII line in FIG. 7 (a view corresponding to FIG. 5), and FIG. 9 a sectional view along IX—IX line in FIG. 7 (a view corresponding to FIG. 4).

In the first embodiment described above, the non-working gas filled in the scavenge filling chambers 18 was the exhaust gas refluxed from the exhaust system (or gas consisting primarily of the exhaust gas). In contrast to it, the present embodiment uses the intake air without fuel introduced from the exterior atmospheric space (or gas consisting primarily of the intake air). In the present embodiment, as shown in FIG. 7, an air passage 17 is provided on the top dead center side with respect to the intake port (intake passage) 15. The air passage 17 has an end thereof opening in the inner surface of the cylinder 12. The height of this opening part is approximately equal to those of the exhaust port 16 and the end apertures 18*a*, 19*a* of the scavenge filling chambers 18 and the scavenging passages 19.

In the present embodiment, a pair of scavenge filling chambers 18 are placed on the side where the intake port 15 and air passage 17 are located. A pair of scavenging passages 19 are placed on the exhaust port 16 side with respect to the pair of scavenge filling chambers 18. In fact, this configuration is realized by replacement of the closed portions of the open ends on the crank chamber 28 side by the gasket 24. A pair of communication paths 41 corresponding to the communication paths 40 in the first embodiment are not formed on the exhaust port 16 side but formed on the intake port 15 and air passage 17 side. The pair of communication paths 41 are also formed in groove shape in the lower end part of the peripheral surface of the piston 33. However, on the aforementioned projection plane (the same as in the first embodiment), the communication paths 41 in the present embodiment extend in the range from the aperture of the air passage 17 to the apertures 18*a* of the scavenge filling chambers 18. When the piston 33 is located in the vicinity of the top dead center, each communication path 41 gets its both ends communicating with the aperture of the air passage 17 and with the aperture 18*a* of the scavenge filling chamber 18, so as to establish mutual communication between the air passage 17 and the scavenge filling chamber 18.

The air passage 17 is used to fill the scavenge filling chambers 18 with the non-working gas (intake air) through the communication paths 41 when the piston 33 is located near the top dead center. At this time, the scavenge filling chambers 18 are under action of the negative pressure in the crank chamber 28 in the intake stroke on the communicating port 21 side. This results in filling the scavenge filling chambers 18 with the non-working gas. At this time, it is preferable to make a positive pressure from the air passage 17 side act on the scavenge filling chambers 18, in order to effect smoother filling with the non-working gas. A conceivable method of making the positive pressure act is a forced feed by means of a pump or the like. The pump may be an electrically driven one, or one using the power of the engine 10.

Air may be introduced into the air passage 17 by branching it from the intake passage on the downstream side of an air filter, or by securing a new intake passage. The air passage 17 opens at its end in the combustion chamber when the piston 33 reaches the bottom dead center. At this time, the intake air is introduced from the air passage 17 into the combustion chamber. This intake air flow, together with the non-working gas filled inside the scavenge filling chambers 18, forms the non-working gas layer. This configuration is also able to make a clear boundary part between the non-working gas layer and the working gas layer introduced from the scavenging passages 19 into the combustion chamber, and to implement reduction of discharge amount of THC, reduction of fuel consumption, and increase of power.

The present invention is by no means limited to the embodiments described above. For example, the above-described embodiments used the gasket 24 to close the scavenge filling chambers 18 on the crank chamber 28 side. This use of the gasket 24 enables easy formation of the scavenge filling chambers 18, but the scavenge filling chambers may also be formed by any other technique than the use of the gasket. For example, the scavenge filling chambers may be closed on the crank case side by other components such as stop members. In that case, the positions of the stop members do not always have to be the crank-case-side ends of the scavenge filling chambers. Furthermore, the position of the aforementioned communicating port 21 can also be optionally set in consideration of the motion of the gas flow.

Since the present invention makes the laminar boundary clear between the non-working gas layer and the working gas layer in the scavenging stroke as described above, the mixed layer is not formed (or is barely formed, if any), and it thus becomes easy to make the non-working gas only undergo blow-by and to keep the working gas only staying in the combustion chamber. This prevents the working gas from being contained as a mixed layer in the blow-by and causing an increase of fuel consumption. The non-working gas is also prevented from remaining as a mixed layer in the combustion chamber and causing a power drop due to a decrease of delivery ratio.

What is claimed is:

1. A two-stroke engine comprising:

a scavenging passage opening in a combustion chamber in a scavenging stroke to fill the combustion chamber with a working gas containing a combustion fuel;

a scavenge filling chamber communicating through a communicating port with the scavenging passage and arranged to be filled with a non-working gas in a fuel weight concentration smaller than that of the working gas prior to the scavenging stroke;

a cylinder block forming the combustion chamber;

a piston to reciprocate in the combustion chamber; and a crank chamber into which the working gas is to be introduced through an intake port;

wherein in the scavenging stroke the scavenging passage and the scavenge filling chamber are made open in the combustion chamber and the non-working gas in the scavenge filling chamber is forced into the combustion chamber by the working gas inside the scavenging passage through the communicating port to scavenge the combustion chamber;

wherein the scavenging passage and the scavenge filling chamber extend in the cylinder block so as to be adjacent to each other along an axial direction of the combustion chamber;

wherein the scavenge filling chamber has an aperture to open in the combustion chamber when the piston is located at a position near a bottom dead center;

wherein the scavenging passage has an aperture to open in the combustion chamber when the piston is located at a position near the bottom dead center, and one end of the scavenging passage is in communication with the crank chamber; and wherein the communicating port opens in a bulkhead interposed between the scavenging passage and the scavenge filling chamber.

2. The two-stroke engine according to claim 1, wherein an opening direction of the communicating port is perpendicular to a gas flow direction in the scavenging passage.

3. The two-stroke engine according to claim 2, wherein a wall part of the scavenge filling chamber on the side of the bottom dead center of the piston is formed by a gasket sandwiched between the cylinder block forming the combustion chamber and a crank case forming the crank chamber.

4. The two-stroke engine according to claim 3, comprising the intake port for introducing the working gas into the crank chamber in communication with the scavenging passage, and an exhaust port to open in the combustion chamber in the scavenging stroke; and wherein on a projection plane normal to a center axis of the combustion chamber, the intake port and the exhaust port are placed at positions substantially opposite to each other with respect to a center of the combustion chamber, and each of the scavenge filling chamber and the scavenging passage comprises a pair arranged one on each side in symmetry with respect to a line connecting the intake port to the exhaust port, and the pair of scavenge filling chambers are located on the exhaust port side with respect to the pair of scavenging passages.

5. The two-stroke engine according to claim 4, wherein the pair of scavenging passages and the pair of scavenge filling chambers each are oriented on the projection plane so that introduced gases therefrom into the combustion chamber collide with each other on the opposite side to the exhaust port.

6. The two-stroke engine according to claim 5, wherein the non-working gas filling the scavenge filling chambers is comprised essentially of an exhaust gas refluxed from an exhaust system; and wherein the exhaust gas to be filled from the exhaust system into the scavenge filling chambers is supplied through a communication path formed in the piston and/or in a wall part of the combustion chamber so as to bring the scavenge filling chambers into communication with the exhaust port, when the piston to reciprocate in the combustion chamber is located near a top dead center.

7. The two-stroke engine according to claim 5, wherein the non-working gas filling the scavenge filling chambers is comprised essentially of intake air without fuel introduced from an exterior atmospheric space; and wherein the intake air to be filled from an intake system into the scavenge filling chambers is supplied through a communication path formed in the piston and/or in the wall part of the combustion chamber so as to bring the scavenge filling chambers into communication with an air passage to supply the intake air without fuel, when the piston to reciprocate in the combustion chamber is located near the top dead center.

* * * * *